US012311284B1

(12) United States Patent
Bouchakian

(10) Patent No.: US 12,311,284 B1
(45) Date of Patent: May 27, 2025

(54) BI-ELLIPTICAL FLYING TOY WITH ANHEDRAL BENT RINGS

(71) Applicant: Myron Bouchakian, Roy, WA (US)

(72) Inventor: Myron Bouchakian, Roy, WA (US)

( * ) Notice: Subject to any disclaimer, the term of this patent is extended or adjusted under 35 U.S.C. 154(b) by 0 days.

(21) Appl. No.: 18/658,007

(22) Filed: May 8, 2024

(51) Int. Cl.
*A63H 33/18* (2006.01)

(52) U.S. Cl.
CPC ..... *A63H 33/18* (2013.01)

(58) Field of Classification Search
CPC ..... A63B 65/08; A63H 33/18
USPC ..... 446/569, 588, 589, 590; 473/46, 48
See application file for complete search history.

(56) References Cited

U.S. PATENT DOCUMENTS 3,181,811 A * 5/1965 Maksim, Jr. ..... B64C 39/06 244/73 R
3,939,602 A * 2/1976 Burke ..... A63H 33/18 446/48
4,182,073 A * 1/1980 Tabet ..... A63H 33/18 473/588
4,456,265 A * 6/1984 Adler ..... B64C 39/06 244/45 R
4,479,655 A * 10/1984 Adler ..... A63B 65/08 473/589
4,560,358 A * 12/1985 Adler ..... A63H 33/18 473/589
4,752,267 A * 6/1988 Layman ..... A63H 33/18 D21/443
D323,000 S * 1/1992 Atwell ..... D21/336
5,100,356 A * 3/1992 Atwell ..... A63H 33/18 446/48
5,131,879 A * 7/1992 Bouchakian ..... A63H 33/18 446/48
5,173,070 A * 12/1992 Gould ..... A63H 33/18 446/256
5,195,916 A * 3/1993 Her ..... A63H 33/18 473/589
5,254,077 A * 10/1993 Nottingham ..... A63H 27/082 473/589
5,269,716 A * 12/1993 Viola ..... A63H 33/18 473/589
D344,989 S * 3/1994 Bouchakian ..... D21/444
5,853,311 A * 12/1998 Bartholomew ..... A63H 33/18 473/588
6,837,813 B2 * 1/2005 Darnell ..... A63H 33/18 473/590
8,157,607 B2 * 4/2012 Cowles ..... A63H 33/22 446/48
D725,198 S * 3/2015 Blonk ..... D21/387
9,039,479 B1 * 5/2015 Green ..... A63H 33/22 446/46
9,345,984 B2 * 5/2016 White ..... A63H 33/18
9,731,216 B2 * 8/2017 Richardson ..... A63H 33/18
9,914,069 B2 * 3/2018 Lehman ..... A63H 33/18
(Continued)

*Primary Examiner* — Joseph B Baldori
(74) *Attorney, Agent, or Firm* — H. Jay Spiegel

(57) ABSTRACT

A bi-elliptical flying toy has two anhedral bent rings. The rings are connected together by struts. Each ring consists of an ellipse. The rings are mounted together with their major axes generally perpendicular to one another. Along the long axes of the rings at the ends of the long axes, the rings droop downward in an anhedral configuration. This configuration stabilizes the toy when it is thrown, substantially precluding the toy from rolling to a side when thrown level.

18 Claims, 8 Drawing Sheets

(56) References Cited

U.S. PATENT DOCUMENTS

| | | | | |
|---|---|---|---|---|
| 11,612,828 | B2 * | 3/2023 | Kocking | A63H 33/18 446/46 |
| 2004/0198137 | A1 * | 10/2004 | Ruiz | A63H 33/18 446/46 |
| 2015/0079869 | A1 * | 3/2015 | Neth | A63H 33/18 446/46 |

* cited by examiner

BI-ELLIPTICAL FLYING TOY WITH ANHEDRAL BENT RINGS

BACKGROUND OF THE INVENTION

The present invention relates to a bi-elliptical flying toy with anhedral bent rings. Applicant is the inventor in U.S. Pat. No. 5,131,879 issued on Jul. 21, 1992 for a bi-elliptical flying toy. The bi-elliptical flying toy has two elliptical rings with the long axes perpendicular to one another and interconnected by struts. The rings have arcuate cross-sections but from an edge view are substantially flat.

Applicant's original flying toy operated effectively. However, Applicant found that when the toy is thrown right handed to impart a clockwise spin on the toy, it would fly through the air but experienced a sharp roll or fade to the left. Conversely, when thrown with the left hand to impart a counterclockwise rotation, the toy would exhibit a sharp roll or fade to the right. As a result of these rolls, it was difficult to throw the toy for long distances because the roll would eventually cause the toy to land on a ground surface a relatively short distance from the thrower.

Applicant conducted numerous experiments to try to eliminate the rolling action of the toy so that it could be thrown long distances and maintain relatively level flight. After considerable effort, Applicant discovered that bending the rings at the ends of the long axes to form an anhedral shape cured the rolling problem and permitted the toy to fly long distances in level flight. This application describes the details of the improvements over the flying toy disclosed and claimed in the '879 patent and for which patent protection is sought.

SUMMARY OF THE INVENTION

The present invention relates to a bi-elliptical flying toy with anhedral bent rings. The present invention includes the following interrelated objects, aspects and features:

(1) In a first aspect, the inventive flying toy is made up of two rings connected together by struts. Each ring consists of an ellipse including two thin and narrow regions merging with two thicker and wider regions at transition regions.

(2) Each ring has a cross-section which is generally arcuate and which terminates at each extreme end thereof by a generally semi-circular protrusion.

(3) The rings are mounted together with their major axes generally perpendicular to one another. As the means for mounting the rings together in this configuration, a plurality of struts are provided, preferably four in number, each of which has side walls which are hyperbolic in nature. The vertical cross-section of a strut reveals two hyperbolae which are configured so that their central regions are closer to one another than their extreme regions.

(4) Along the long axes of the rings at the ends of the long axes, the rings droop downward in an anhedral configuration. This configuration stabilizes the toy when it is thrown, substantially precluding the toy from rolling to a side when thrown level.

(5) When the inventive flying toy is thrown, it tends to fly level and arrive at a hovering configuration not unlike a helicopter as the oblong ends of the elliptical rings serve as "gyroscopic blades" to provide stability.

As such, it is a first object of the present invention to provide a bi-elliptical flying toy with anhedral bent rings.

It is a further object of the present invention to provide such a device wherein two elliptical rings are mounted together with their major axes perpendicular to one another.

It is a yet further object of the present invention to provide such a device wherein the rings are mounted together through the use of hyperbolically configured struts.

It is a yet further object of the present invention to provide such a device wherein each ring includes thin, narrow regions merging into thick, wider regions at transition regions.

It is a yet further object of the present invention to provide such a toy in which the ends of the long axes of the rings droop downward in an anhedral configuration to stabilize the toy when thrown and substantially preclude rolling when thrown level.

These and other objects, aspects and features of the present invention will be better understood from the following detailed description of the preferred embodiment when read in conjunction with the appended drawing figures.

SPECIFIC DESCRIPTION OF THE PREFERRED EMBODIMENT

Figure 1:
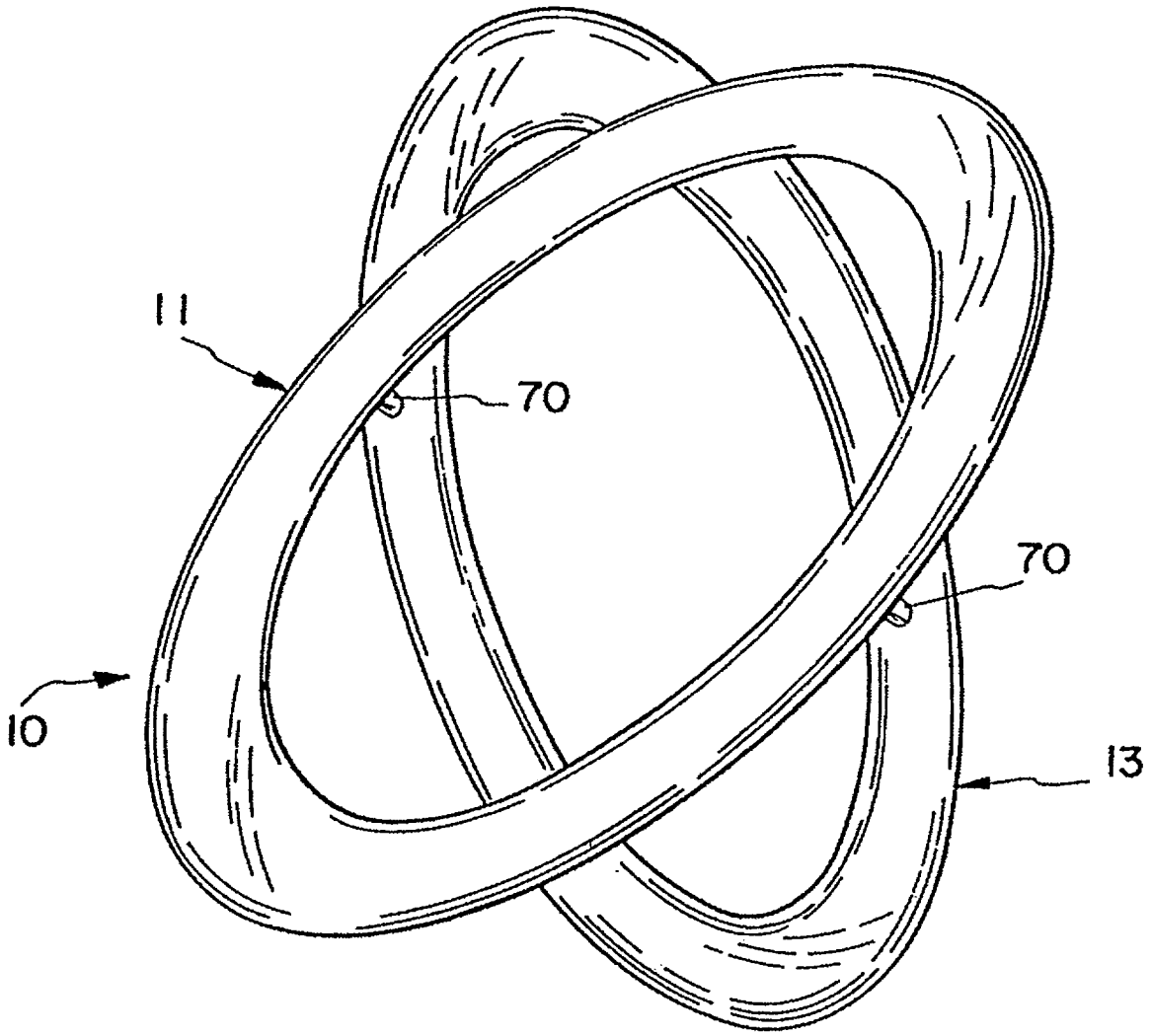
FIG. 1 shows a perspective view of the present invention.

With reference, first, to FIG. 1, the inventive bi-elliptical flying toy with anhedral bent rings is generally designated by the reference numeral 10 and is seen to include an upper ring 11 and a lower ring 13.

Figure 4:
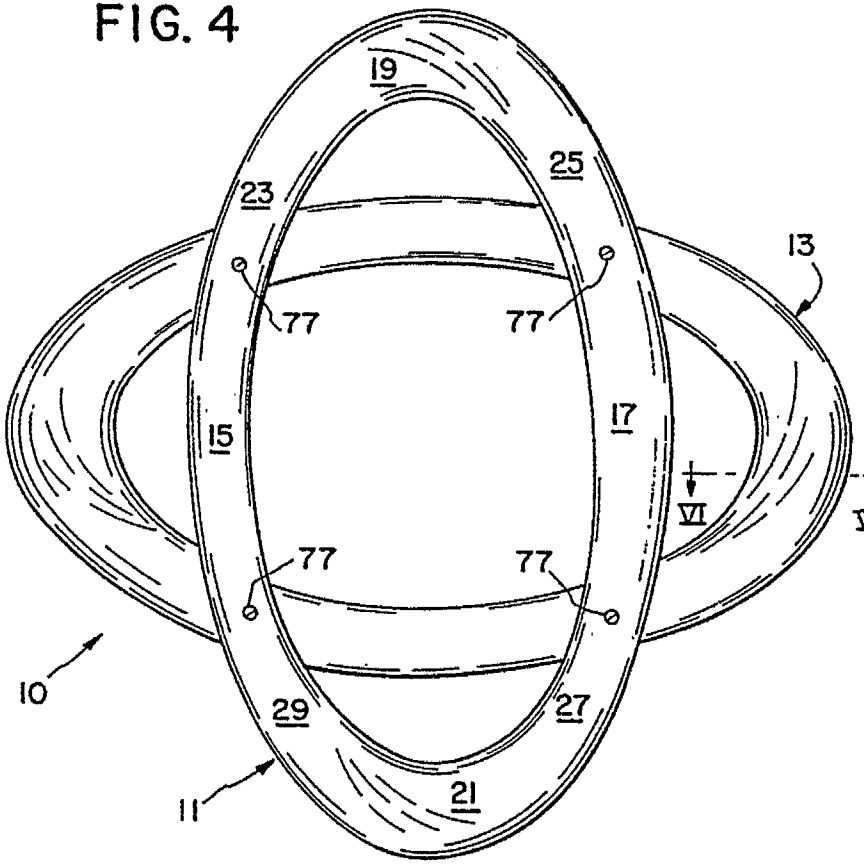
FIG. 4 shows a top view of the present invention.

With reference to FIG. 4, it is seen that the upper ring 11 is elliptical in shape having a major axis vertically oriented in the view of FIG. 4 and a minor axis which is horizontally oriented in the same view. The ring 11 has relatively thinner, narrower regions 15, 17, relatively wider, thicker regions 19, 21 and four transition regions, including the transition region 23 between the regions 15 and 19, the transition region 25 between the regions 17 and 19, the transition region 27 between the regions 17 and 21 and the transition region 29 between the regions 15 and 21.

As should be understood from the view of FIG. 4, as one goes about the circumference of the ring 11, the transition regions are between respective narrower, thinner regions and wider, thicker regions and allow a smooth transition on the surfaces of the ring 11 between thinner, narrower regions and thicker, wider regions.

Figure 5:
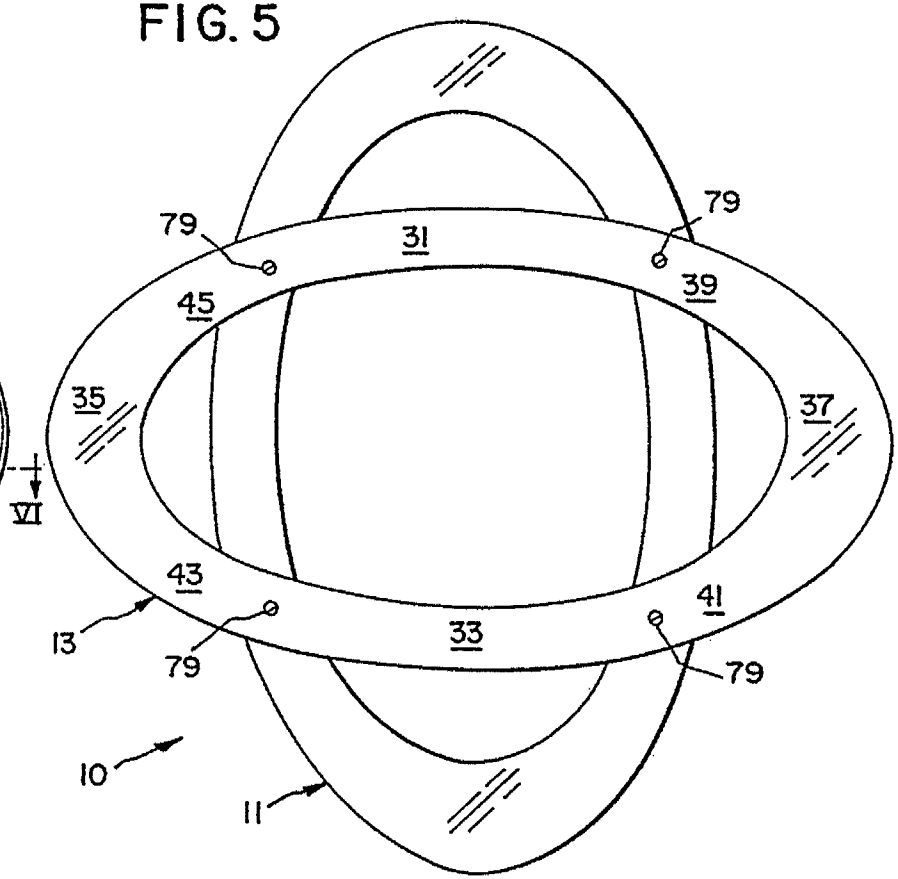
FIG. 5 shows a bottom view of the present invention.

With reference to FIG. 5, it is seen that the lower ring 13 includes thinner, narrower regions 31, 33, relatively thicker, wider regions 35, 37 and transition regions 39, 41, 43 and 45. The transition region 39 is between the regions 31, 37; the transition region 41 is between the regions 33 and 37; the transition region 43 is between the regions 33 and 35; and the transition region 45 is between the regions 31 and 35. The rings 11 and 13 are identical to one another.

Figure 6:
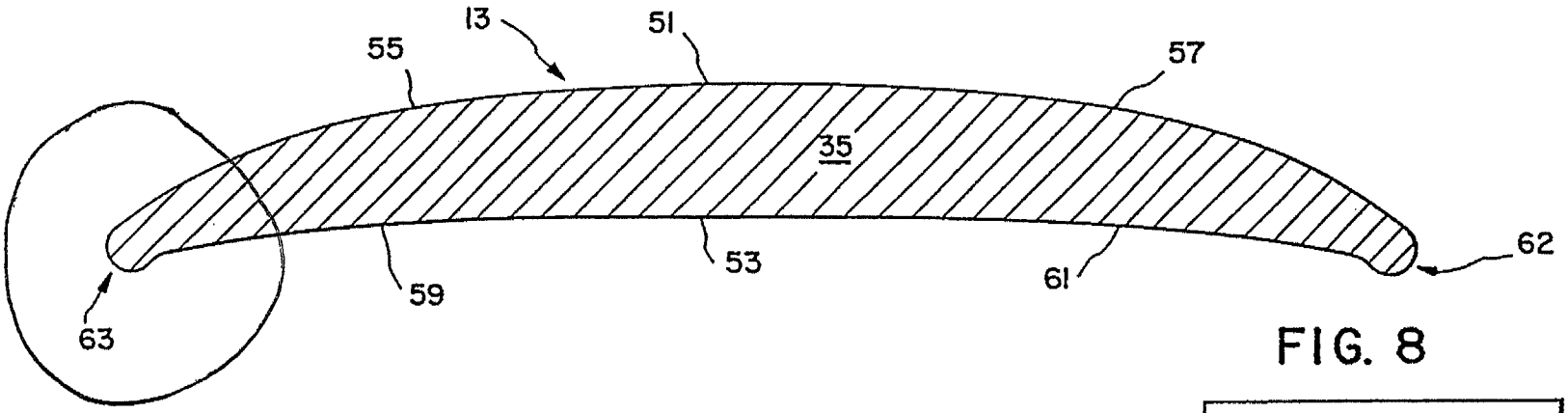
FIG. 6 shows an enlarged cross-sectional view along the line VI-VI of FIG. 4.

FIG. 6 shows a cross-sectional view of the region 35 of the ring 13. This cross-sectional view is representative of the cross-section of each ring throughout its circumference. In the thinner, narrower regions such as, for example, the regions 31 and 33, the dimensions shown in FIG. 6 will be narrower and thinner. However, the general shape and outline will conform to that which is shown in FIG. 6.

With reference to FIG. 6, the cross-section is seen to include upper and lower central portions 51 and 53 which are generally flat. To either side of the central portion 51, arcuate side regions 55 and 57 are provided. The lower central portion 53 has two side regions adjacent thereto designated by the reference numerals 59 and 61 which are also arcuate but on a greater radius of curvature than the regions 55 and 57.

Figure 7:
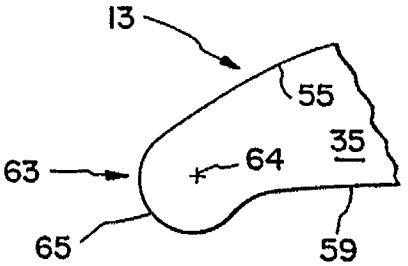
FIG. 7 shows a further enlarged view of the portion of FIG. 6 which is contained within the circle shown in FIG. 6.

With reference to FIG. 7, the regions 55 and 59 are seen to converge at a generally semi-circular protrusion 63 which has a center point 64. As shown, the configuration of the protrusion 63 consists of an outer circular surface 65 which "droops" down below the arcuate region 59. The protrusion 62 on the other side of the ring 13 is symmetrical with the protrusion 63. As should be understood, the ring 13 as well as the ring 11 have this same structure, with the actual structure consisting of an annulus projecting the protrusions 62, 63 about the circumference of the ring 13 and in analogous fashion concerning the ring 11.

Figure 2:
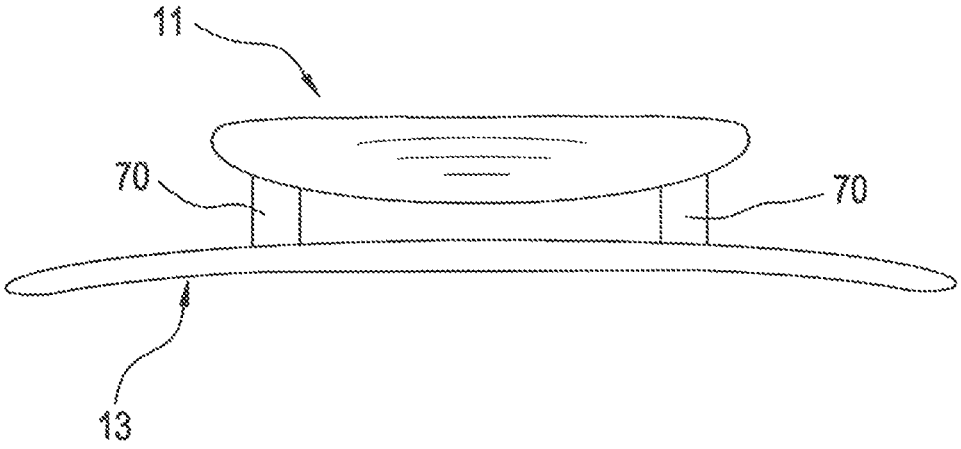
FIG. 2 shows a side view along the major axis of the lower one of the rings of the present invention showing its anhedral downward bend.
Figure 3:
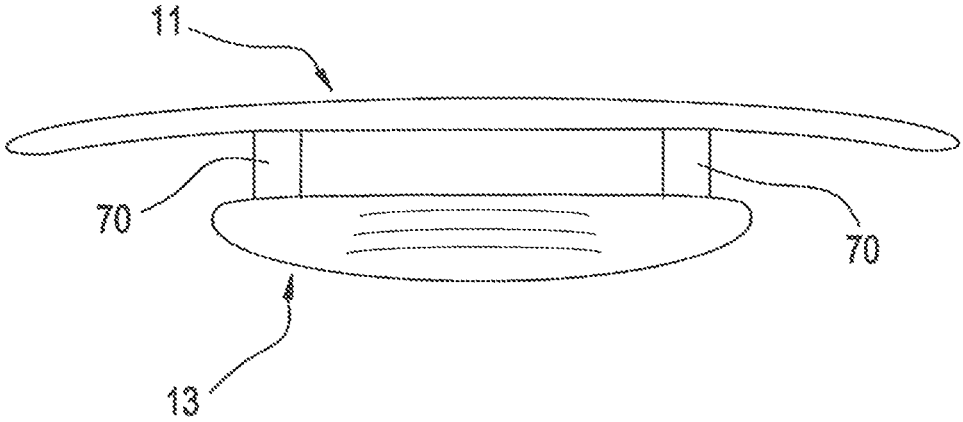
FIG. 3 shows a side view along the major axis of the upper one of the rings of the present invention showing its anhedral downward bend.
Figure 8:
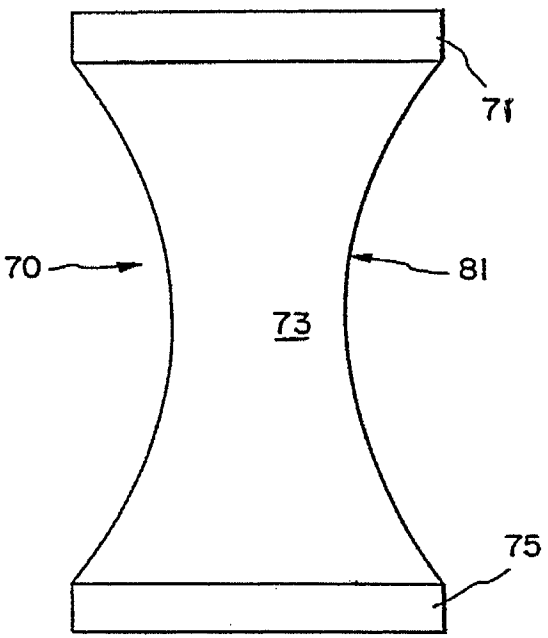
FIG. 8 shows an enlarged cross-sectional view of one of the struts of the present invention.

FIG. 8 shows a strut 70. Four such struts 70 are used to hold the rings 11, 13 in the mounted orientation with respect to one another as best seen in FIGS. 1, 2 and 3, and as represented by the screws 77, 79 seen in FIGS. 4 and 5. As seen in FIG. 8, the strut 70 has a top portion 71, a central region 73 and a bottom portion 75. The portions 71 and 75 are attached to the rings 11 and 13 respectively. FIG. 4 shows screws 77 which may be fastened through the ring 11 and into the respective top portions 71 of the struts 70 to fasten the ring 11 thereto. Similarly, with reference to FIG. 5, screws 79 may be provided to allow fastening of the ring 13 to the bottom portions 75 of the struts 70. Of course, the screws 77, 79 are merely exemplary of the means which may be employed to fasten the struts 70 between the rings 11, 13. Any suitable means such as adhesive, screws, bolts, etc. may be suitably employed. In the case of the screws 77, 79, it is only important to note that they are employed in a manner such that their top surfaces are flush with the corresponding surfaces of the rings 11, 13 so that the screws 77, 79 do nothing to effect the aerodynamics of the inventive device 10.

With further reference to FIG. 8, it is seen that the strut 70 has, in its central region 73, a peripheral wall 81 which, in cross-section, consists of two hyperbolae having configurations which converge toward one another in the center of the strut 70. The surface 81 is annular and surrounds the central region 73 defining its extent. The hyperbolic nature of the struts 70 is intentionally provided to correct aerodynamics by decreasing air drag below what drag would be were the struts to be cylindrical, while improving the strength of the connection between the upper and lower rings 11, 13 respectively. If desired, the inventive device 10 may be manufactured in one piece with the top portion 71 of each strut 70 being integral with the ring 11 and with the bottom portion 75 of each strut 70 being integral with the bottom ring 13.

Figure 9:
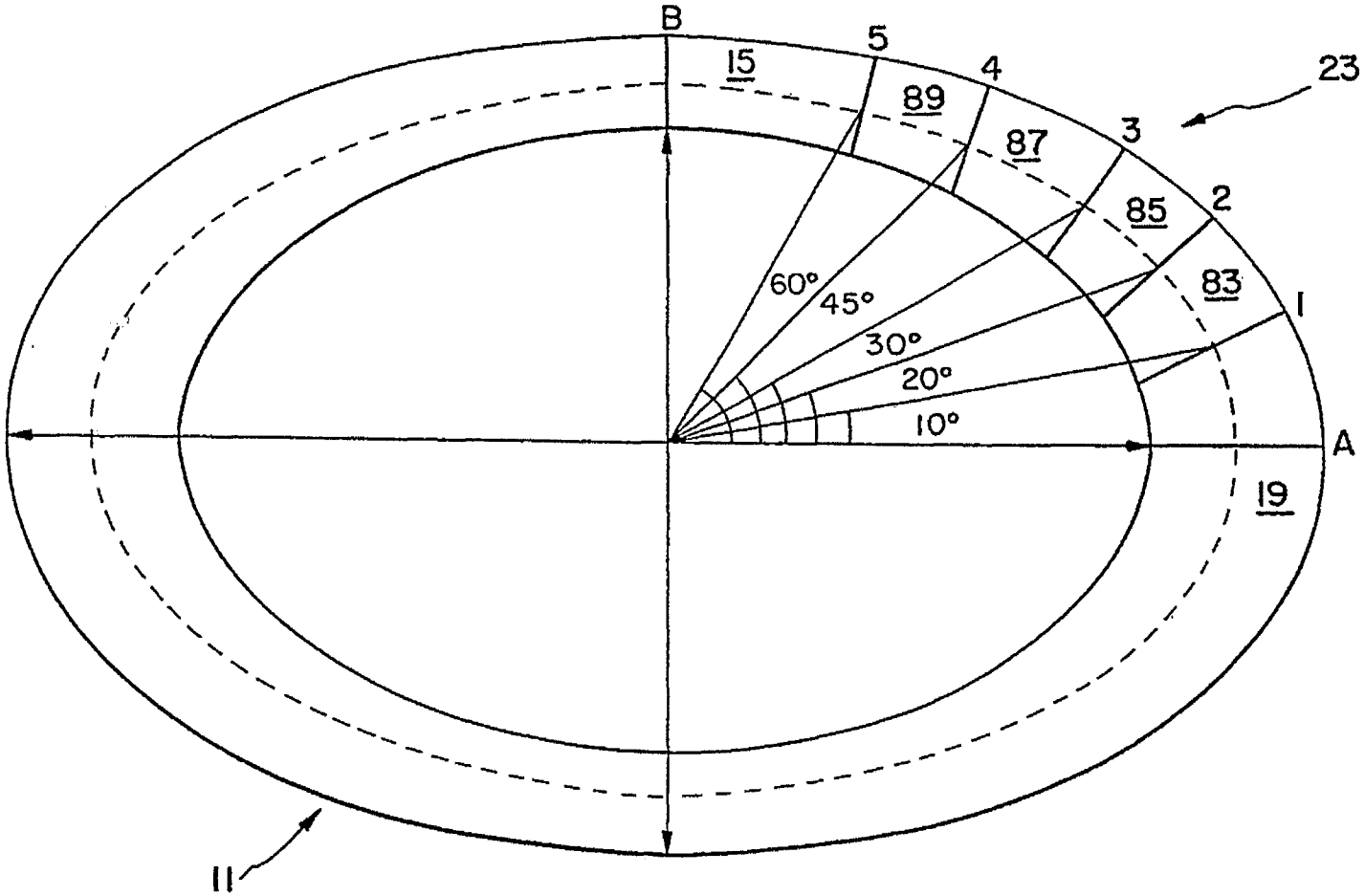
FIG. 9 shows a schematic representation of one of the inventive rings, viewed from above.

With reference, now, to FIG. 9, further details concerning the various regions on a ring made in accordance with the teachings of the present invention will now be disclosed. For purposes of discussion, the FIG. 9 ring will be explained with reference to the reference numerals depicting the ring 11. Thus, the ring 11 has a region 19 which is relatively wider and thicker, a region 15 which is relatively thinner and narrower and a transition region 23 therebetween. As seen in FIG. 9, the transition region 23 may be considered to be divided up into four sub-regions designated by the reference numerals 83, 85, 87 and 89. Thus, in each quadrant of the ring 11, there are six airfoils integrated and smoothed around the periphery of the ring 11 to provide smooth transitions therebetween.

Figure 10:
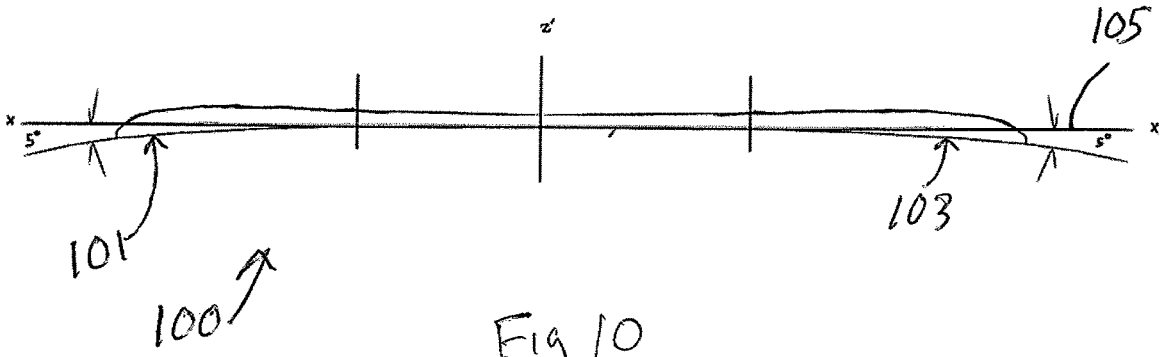
FIG. 10 shows a side view along a major axis of a ring showing a 5° anhedral angle.
Figure 11:
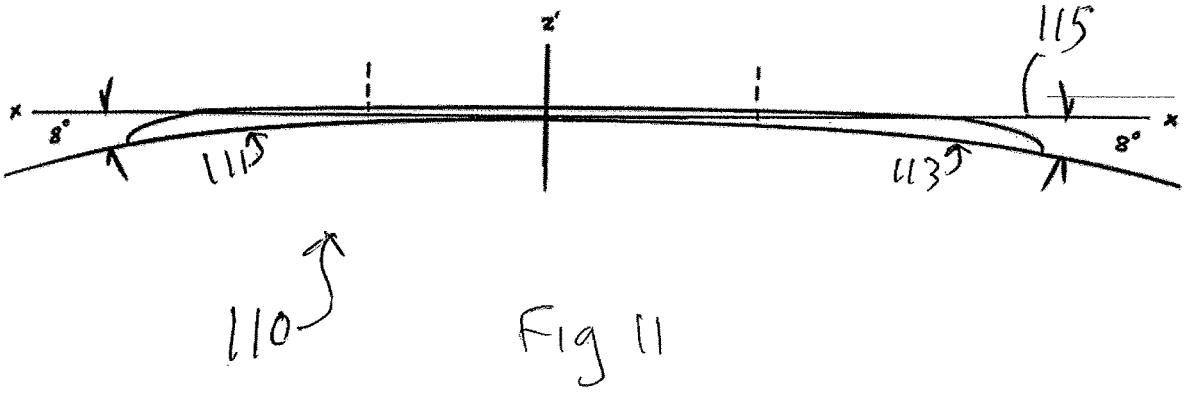
FIG. 11 shows a side view along a major axis of a ring showing an 8° anhedral angle.
Figure 12:
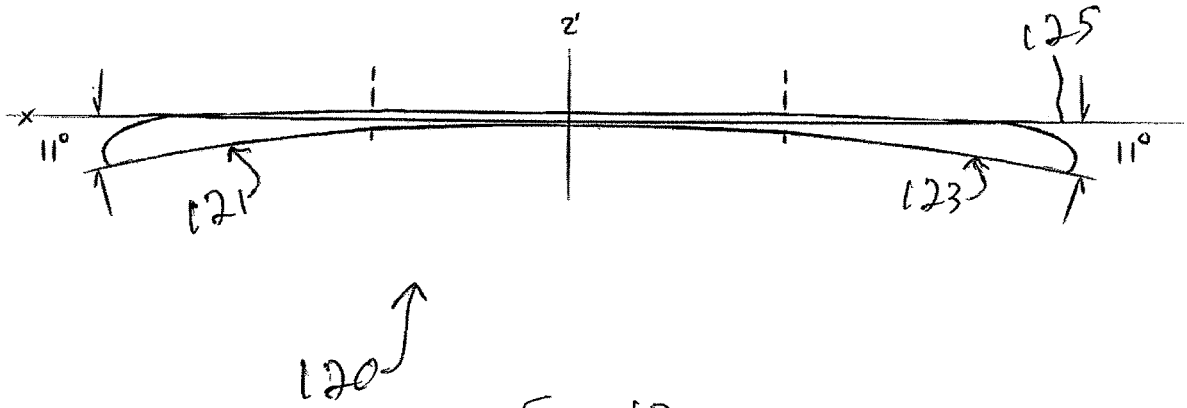
FIG. 12 shows a side view along a major axis of a ring showing an 11° anhedral angle.

FIGS. 10-12 show schematic representations along the long axis of a ring to show differing degrees of anhedral bend. Thus, FIG. 10 shows a ring 100 having an axis 105 and ends of the ring 101 and 103 showing an anhedral bend of 5°. FIG. 11 shows a ring 110 having an axis 115 and ends of the ring 111 and 113 showing an anhedral bend of 8°. FIG. 12 shows a ring 120 having an axis 125 and ends of the ring 121 and 123 showing an anhedral bend of 11°.

As explained supra, Applicant discovered that when the patented version of the inventive toy was thrown with a clockwise spin from a right handed throw, it would sharply roll or fade to the left, whereas when thrown left handed imparting a counterclockwise spin, a sharp roll or fade to the right would occur. Applicant found after considerable experimentation that imparting an anhedral bend at the ends of the long axis of each ring would result in stabilization of the toy so that it would fly straight for significantly long distances without rolling or fading.

The present invention contemplates an anhedral bend along the long axis of each ring within the range of 3 to 12°. In experimenting with various degree levels within the range of 3°-12°, Applicant found that for intermediate distance games of catch, an anhedral bend within the range of 4 to 7 is sufficient to stabilize the toy. Such distances are preferably within the range of about 30 to 50 feet. On the other hand, when the purpose for using the toy is longer distance flight, a greater anhedral bend, preferably within the range of 8° to 12° is preferred because this greater anhedral bend better compensates for the greater gyroscopic force instantly created from throwing the toy with the greater force necessary to facilitate a longer distance throw. In other words, the rings rotate at a higher rate of rotation when thrown for a longer distance than is the case where the throw is for a shorter distance.

In developing the present invention, the goal was to maximize the flight attributes of lift, glide, and distance while minimizing roll or fade. The criteria that needed to be considered are the width and shape of the elliptical rings, width distribution from the periphery of the rings toward the middle of them, thickness and weight of the toy, specific gravity of the material used to manufacture it, the vertical spacing between the rings, overall size of the toy, the airfoil camber of each cord line used through the four quadrants of the ellipse (FIG. 9), and others.

In the preferred embodiment of the present invention, the toy is made of a molded plastic material. The material must be rigid enough that the rings are not "floppy" and do not change their configurations in flight. Thus, the rings are made sufficiently thick enough and out of a rigid material such as molded plastic so that they maintain their shape during flight. Applicant has found that maintaining the anhedral bend within the range of 3 to 12° is critical in stabilizing the toy during flight so that it does not roll or fade during flight. Other suitable materials include Balsa wood or a foam plastic.

Thus, the present invention contemplates a dynamically balanced flying toy having two elliptical rings fixedly mounted together using hyperbolic struts and with the major axes of the rings being perpendicular to one another and with the ends of the rings along their long axis being bend downward in an anhedral bend in the range of 3 to 120. If desired, the rings may be made in different colors with respect to one another so that when the inventive flying toy 10 is thrown, a fluttering visual effect will result, which is aesthetically pleasing for the user and viewers. When the inventive device is thrown, it eventually begins to hover like a helicopter as the oblong ends of the elliptical rings serve as gyroscopic blades, providing stability as the toy 10 descends to the ground.

As such, an invention has been disclosed in terms of a preferred embodiment thereof which fulfills each and every one of the objects of the present invention as set forth hereinabove and provides a new and useful bi-elliptical flying toy with anhedral bent rings of great novelty and utility.

Of course, various changes, modifications and alterations in the teachings of the present invention may be contemplated by those skilled in the art without departing from the intended spirit and scope thereof. As such, it is intended that the present invention only be limited by the terms of the appended claims.

The invention claimed is:

1. A flying toy, comprising:

a) a first elongated ring having major and minor axes of elongation;

b) a second elongated ring having major and minor axes of elongation;

c) said major axes of said rings being angularly displaced from one another;

d) said rings being mounted together in spaced relation; and e) ends of said rings along said major axes being bent downward in an anhedral configuration defined by a downward angle of 3° to 12° with respect to a plane in common with a central portion of each ring, and said rings having cross-sections having downwardly arcuate opposed side regions connected by respective generally flat central portions.

2. The flying toy of claim 1, wherein struts are fastened between said rings to maintain them in spaced relation.

3. The flying toy of claim 2, wherein each strut has an exterior hyperbolic wall.

4. The flying toy of claim 3, comprising 4 struts.

5. The flying toy of claim 2, comprising 4 struts.

6. The flying toy of claim 1, wherein said major axes of elongation are perpendicular to one another.

7. The flying toy of claim 1, wherein each ring is wider at ends of said major axes than at ends of said minor axes.

8. The flying toy of claim 1, wherein said major axes of elongation are perpendicular to one another.

9. The flying toy of claim 1, wherein each ring is wider at ends of said major axes than at ends of said minor axes.

10. The flying toy of claim 1, wherein said rings are made of plastic.

11. A flying toy, comprising:

a) a first elliptical ring having major and minor axes of elongation;

b) a second elliptical ring having major and minor axes of elongation;

c) said major axes of said rings being perpendicular to one another;

d) said rings being mounted together in vertically spaced relation; and e) ends of said rings along said major axes being bent downward in an anhedral configuration making an angle of 3° to 12° from said respective major axes and said rings having cross-sections having downwardly arcuate opposed side regions connected by respective generally flat central portions.

12. The flying toy of claim 11, wherein struts are fastened between said rings to maintain them in spaced relation.

13. The flying toy of claim 12, wherein each strut has an exterior hyperbolic wall.

14. The flying toy of claim 13, comprising 4 struts.

15. The flying toy of claim 11, wherein said anhedral configuration is defined with respect to a plane in common with a central portion of each ring.

16. The flying toy of claim 11, wherein each ring is wider at ends of said major axes than at ends of said minor axes.

17. The flying toy of claim 11, wherein said rings are made of plastic.

18. The flying toy of claim 11, wherein said rings are made of Balsa wood.

* * * * *